United States Patent [19]

Mosch

[11] Patent Number: 4,813,725

[45] Date of Patent: Mar. 21, 1989

[54] CONCEALED CHECK RAIL LOCK AND KEEPER

[75] Inventor: Duane L. Mosch, Owatonna, Minn.

[73] Assignee: Truth Incorporated, Owatonna, Minn.

[21] Appl. No.: 198,672

[22] Filed: May 24, 1988

Related U.S. Application Data

[63] Continuation of Ser. No. 929,486, Nov. 21, 1986, abandoned.

[51] Int. Cl.[4] ..... E05C 3/04

[52] U.S. Cl. ..... 292/241; 292/DIG. 53

[58] Field of Search ..... 292/240, 241, 242, DIG. 20, 292/DIG. 35, DIG. 46, DIG. 47, 67, DIG. 53, 346

[56] References Cited

U.S. PATENT DOCUMENTS

| | | | |
|---|---|---|---|
| 190,341 | 5/1877 | Lambkin . | |
| 404,916 | 6/1889 | Koenen | 292/241 |
| 423,761 | 3/1890 | Hasenpflug | 292/241 |
| 550,873 | 12/1895 | Eaches et al. . | |
| 584,343 | 6/1897 | Froelich . | |
| 797,768 | 8/1905 | Fisher | 292/240 X |
| 897,623 | 9/1908 | Howland | 292/241 |
| 946,172 | 1/1910 | Tayntor | 292/67 |
| 1,071,509 | 8/1913 | Courson | 292/241 |
| 1,144,289 | 6/1915 | Blair et al. | 292/140 |
| 1,230,021 | 6/1917 | Pembroke | 292/241 |
| 1,560,654 | 11/1925 | Brede | 292/241 |
| 1,799,480 | 4/1931 | Rudder | 292/241 |
| 1,900,936 | 3/1933 | Huttger | 292/240 X |
| 1,948,542 | 2/1934 | Repass | 292/267 |
| 2,135,105 | 11/1938 | Knauff | 292/241 X |
| 2,258,617 | 10/1941 | Knauff | 292/241 |
| 2,581,816 | 1/1952 | Schlueter | 292/240 X |
| 2,855,236 | 10/1958 | Knauff | 292/241 |
| 3,078,704 | 2/1963 | Rifkin | 292/D.20 X |
| 3,347,580 | 10/1967 | Whiting | 292/242 X |
| 4,293,154 | 10/1981 | Cassells | 292/D.47 X |

FOREIGN PATENT DOCUMENTS

| | | | |
|---|---|---|---|
| 2140313 | 4/1972 | Fed. Rep. of Germany | 292/241 |
| 150564 | 1/1932 | Switzerland | 292/241 |
| 3406 | 3/1887 | United Kingdom | 292/241 |
| 17121 | 12/1887 | United Kingdom | 292/241 |

*Primary Examiner*—Richard E. Moore

*Attorney, Agent, or Firm*—Wood, Dalton, Phillips, Mason & Rowe

[57] ABSTRACT

A concealed cam lock and keeper both of which can be mounted within cavities in the check rails of the respective lower and upper sash of a double hung window. The concealed cam lock has only an exposed handle with a raised section of the housing closing off a notch required for assembly of the housing with the check rail. The handle of the check rail lock has an offset to cover any wood splintering that may have occurred in the check rail of the lower sash in forming the check rail for receiving the housing of the check rail lock.

The keeper is mountable in a cavity in the check rail of the upper sash at a location to permit mounting of weather stripping therebeneath and generally at the level of the lower edge of the window glazing and has downwardly inclined openings to receive fasteners for attaching the keeper to the check rail and which can extend into the check rail without interference with the glazing.

8 Claims, 1 Drawing Sheet

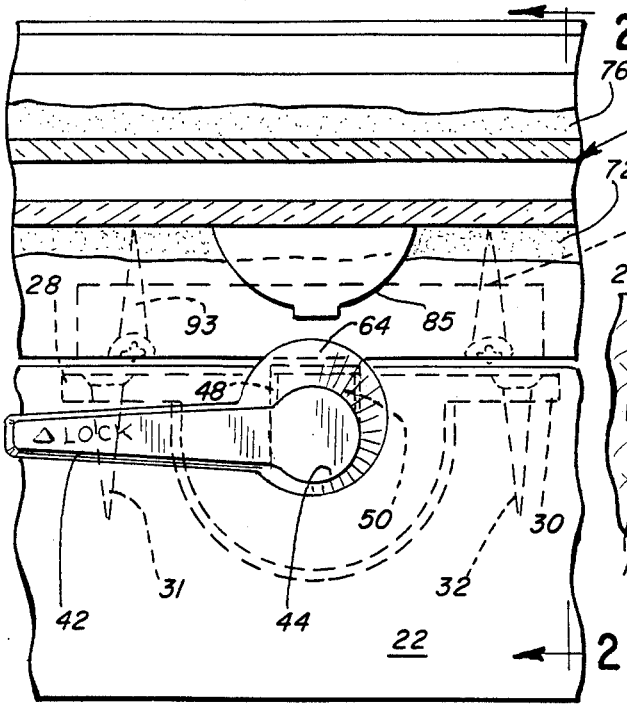
FIG. 1
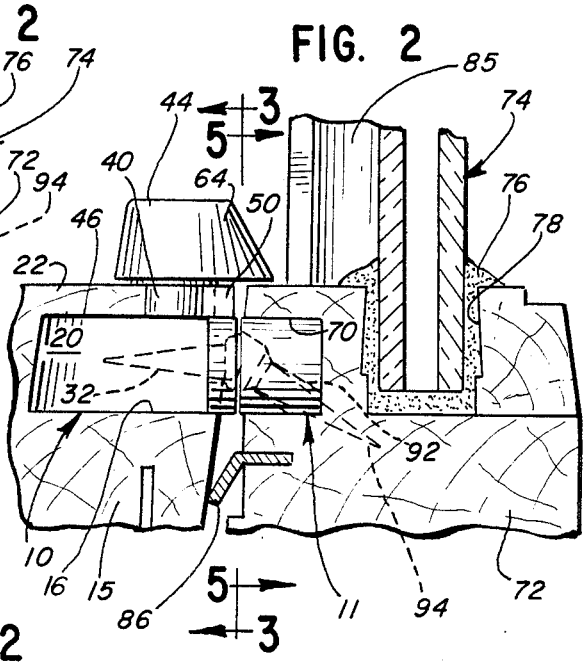
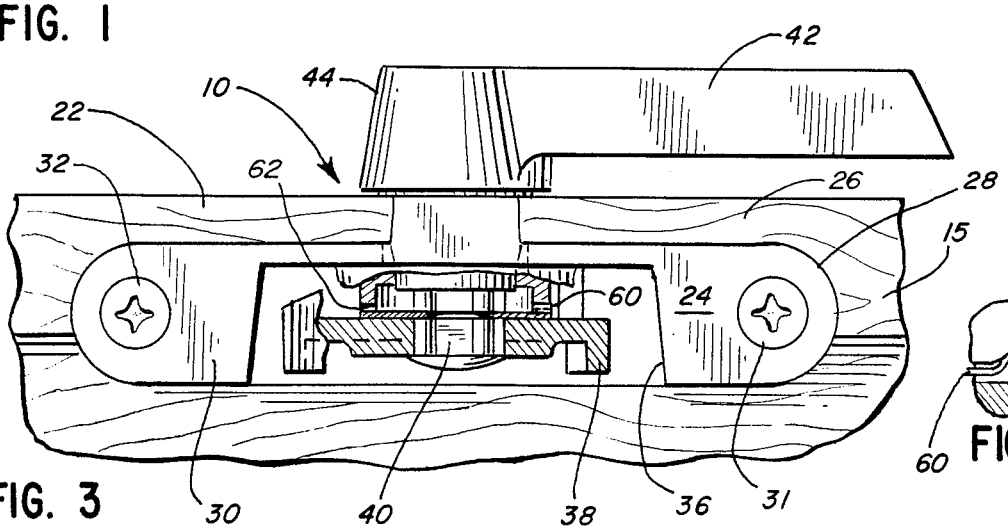
FIG. 3
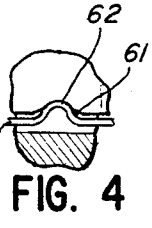
FIG. 4
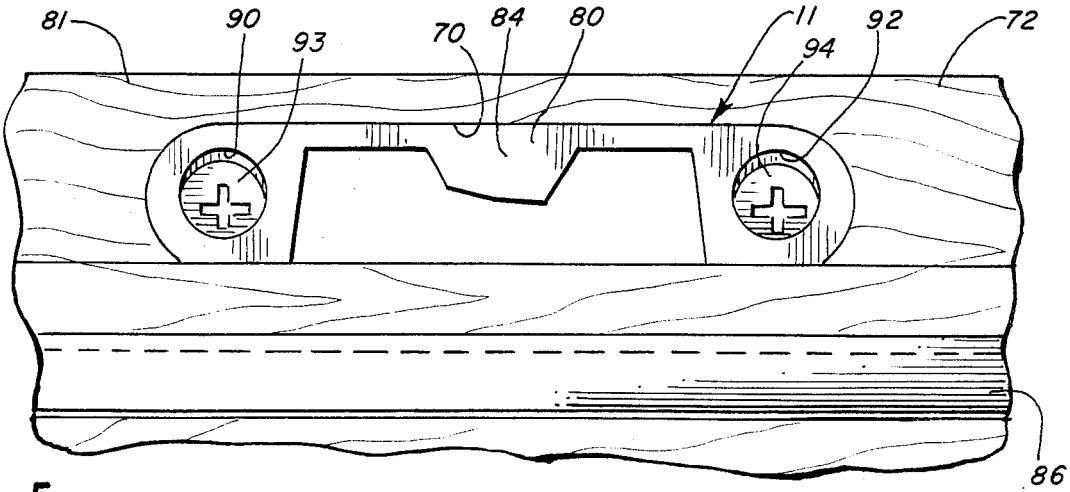
FIG. 5

CONCEALED CHECK RAIL LOCK AND KEEPER

This application is a continuation, of application Ser. No. 929,486, filed 11/12/86.

BACKGROUND OF THE INVENTION

This invention pertains to a check rail lock and keeper which except for the operating handle can be completely concealed within the check rails of the upper and lower sash of a double hung window. Each of the check rails is provided with a cavity with the cavity in the check rail of the lower sash receiving and enclosing a check rail lock housing having an exposed face and which rotatably mounts a locking cam operable by a rotatable shaft extending upwardly from the housing and having a handle at a level above the check rail associated with the rotatable shaft. A keeper is positioned in and enclosed in a cavity in the check rail of the upper sash at a location to permit the mounting of weather stripping and has downwardly inclined openings extending from the front face thereof enabling the insertion of fastening members into the check rail without interfering with window glazing. Other improvements and refinements are described hereinafter.

The concealed check rail lock has a number of components known in prior art structures and particularly as shown in my copending application Ser. No. 821,004 filed Jan. 22, 1986 now U.S. Pat. No. 4,736,972 granted Apr. 12, 1988. The prior check rail lock has a housing mountable to the top of a check rail and which mounts a rotatable shaft having a locking cam disposed internally of the housing and a handle secured to the shaft externally of the housing. A locking cam is rotatable between locked and unlocked positions as determined by limit stops within the housing and a spring detent washer detents the locking cam in either of these positions. A coacting keeper interengages with the locking cam in a locked position.

SUMMARY OF THE INVENTION

A primary feature of the invention is to provide a new and improved concealed check rail lock and keeper having components insertable in cavities in the check rails of the upper and lower sash of a double hung window with one component being a housing having a rotatable locking cam disposed internally thereof and with a rotatable shaft mounting the locking cam and having only a handle secured to the shaft which is exposed to view. Another component is a keeper which is mountable in a cavity in the check rail of the upper sash with only an exposed front face and with downwardly inclined openings for receiving fasteners which can extend downwardly into the upper sash check rail without interference with window glazing. The keeper can be at the level of the lower edge of the window glazing while still being located at a distance from the lower edge of the upper sash check rail to permit the mounting of weather stripping.

More particularly, the concealed check rail lock has a housing with a rotatable shaft extending upwardly therefrom and a locking cam within the housing secured to the shaft. A handle is secured to the upper end of the shaft at a distance from the housing. The housing can be mounted in a cavity of the check rail of the lower sash of a double hung window and have an exposed face. The check rail has a notch above the cavity to permit assembly with the part of the shaft above the housing positioned in the notch and a raised section of the housing fits within the remainder of the notch to coact with the upper surface of the check rail to form a smooth continuous surface. The keeper fits within a cavity in the check rail of the upper sash of the double hung window to have only an exposed face. The keeper is at the level of the lower part of the window glazing and above the lower edge of the check rail to permit mounting of weather stripping material. The keeper has at least a pair of openings extending to the face of the keeper which are downwardly inclined to permit the insertion of fasteners into the check rail without interfering with the glazing.

Additionally, the handle has a generally frusto-conical section at the upper end of the shaft and with an offset which overlies the notch and a portion of the check rail of the upper sash when the handle is in locked position and which moves to a position out of overlapped relation with the upper sash check rail when the lock is in an opened position.

An object of the invention is to provide a new and improved concealed check rail lock and keeper having a housing and a keeper which can both be enclosed within cavities formed in the check rails of the sash of a double hung window with only an operating handle exposed.

Still another object of the invention is to provide a concealed check rail lock and keeper as defined in the preceding paragraph wherein both the housing and keeper are constructed to provide a neat and pleasing appearance for a window and with the structural features of the keeper enabling mounting thereof in a position to enable the use of weather stripping between the check rails and fastener members which can secure the keeper to the check rail of the upper sash without interference from the window glazing.

Still another object of the invention is to provide a concealed check rail lock for mounting on a double hung window having upper and lower sash with check rails in alignment when the window is closed comprising, a housing with a top wall and an interior space and having a raised section, a shaft rotatably mounted in said housing and extending outwardly thereof to the rear of the raised section, a locking cam in said housing fixed to said shaft, and a handle fixed to an end of the shaft at a distance from the top wall and overlying said raised section whereby said housing can fit within a cavity formed in the check rail of the lower sash and a notch formed in said last mentioned check rail above said cavity receives said raised section to have only said handle above the surface of the lower sash check rail.

A further object of the invention is to provide a concealed check rail lock and keeper having a housing with a locking cam mountable in a cavity of the check rail of the lower sash of a double hung window and a keeper mountable in a cavity of the check rail of the upper sash of such a window and at the level of glazing in said upper sash, said keeper having a face flush with a face of the upper sash check rail, and means defining a pair of fastener receiving openings at said face of the keeper which extend downwardly at an angle to receive fastening members which avoid contact with the glazing.

A further object of the invention is to provide a concealed cam lock and keeper comprising, in combination, a housing having a rotatable locking cam and a keeper for engagement by said locking cam, the improvement wherein both said housing and keeper may be hidden from view by mounting in cavities formed in the adjacent check rails of upper and lower sash of a window, said housing having a top wall, a rotatable shaft extending through said top wall and secured to said locking cam within the housing, a handle fixed to said shaft at a distance from said top wall, a raised section of said housing extending between a front face of the housing and said shaft, and said keeper having a pair of downwardly inclined fastener openings at a front face thereof whereby fasteners may extend through said openings into the check rail.

Still another object of the invention is to provide a concealed cam lock as defined in the preceding paragraph wherein the handle has a generally frusto-conical shape surrounding said shaft and which has an offset extending beyond the face of the housing when the handle is in a locked position.

BRIEF DESCRIPTION OF THE DRAWINGS

FIG. 1 is a plan view of the concealed check rail lock shown in association with the sash check rails of a double hung window;

FIG. 2 is a vertical sectional view taken generally along the line 2—2 in FIG. 1;

FIG. 3 is a vertical section taken generally along the line 3—3 in FIG. 2;

FIG. 4 is a sectional view taken along the line 4—4 in FIG. 3; and

FIG. 5 is a vertical view taken along the line 5—5 in FIG. 2.

DESCRIPTION OF THE PREFERRED EMBODIMENT

The concealed check rail lock is indicated generally at 10 and the concealed keeper is indicated generally at 11. These components are mountable in the check rails of upper and lower sash of a double hung window. The check rail 15 of the lower sash has a cavity 16 to receive a housing 20 of the check rail lock and with the housing 20 being concealed by an upper part 22 of the check rail. The housing 20 has a front face 24 generally flush with an exposed vertical face 26 of the check rail 15 with lateral extensions 28 and 30 each having an opening to receive a fastening member in the form of attaching screws 31 and 32, respectively, which thread into the check rail. The housing has an internal chamber 36 opening to the front face 24 thereof with a rotatable locking cam 38 being mounted in this chamber and being fixed to a shaft 40 rotatably mounted in the housing and extending upwardly therefrom as seen particularly in FIG. 2. The shaft has a handle 42 formed integrally therewith or separate therefrom but fixed thereto with a generally frusto-conical section 44 spaced from a top wall 46 of the housing 20 and lying immediately above the top surface of the check rail 15.

In assembly of the check rail lock into the check rail 15, the cavity 16 is formed in the check rail and also a notch is cut inwardly from the front face 26 of the check rail through the top portion 22 thereof to permit passage of the exposed part of the shaft 40 to the position shown in FIG. 2. A raised section 50 of the housing extends above the housing top wall 46 and between the exposed part of the shaft 40 and the housing front face 24 to fill the notch 48 and form a continuous upper surface for the check rail 15.

The mechanism within the chamber 36 of the check rail lock including the rotatable locking cam 30 is of the construction shown in my prior copending application previously referred to and the disclosure thereof is incorporated herein by reference. A rotatable locking cam 38 is rotatable between locked and unlocked positions by rotation of the handle 42 between a locked position shown in the drawings and an unlocked position wherein the handle is rotated through approximately 180° in a counterclockwise direction as viewed in FIG. 1. The limits of rotation of the rotary locking cam are controlled by an abutting relation between structure on the housing and the rotatable locking cam and the locking cam can be held in either position by means of a spring washer 60 keyed to the rotatable shaft 40 and having one or more detents 61 which coacts with a detent cavity 62 formed on the housing 20.

In order to cover any splintering of the wood structure of the check rail 15 in formation of the notch 48, the frusto-conical handle section 44 has an offset part 64 which overlies the raised section 50 of the housing and part of the check rail of the upper sash when the handle 42 is in locked position.

The keeper 11 is mounted in a cavity 70 of a check rail 72 of the upper sash and with the upper sash having glazing indicated generally at 74 with the lower part thereof embedded in mounting material 76 positioned within a cavity 78 of the check rail. The keeper 11 has a face 80 which is mountable generally flush with a vertical face 81 of the check rail 72 and has a depth dimension approximately equal to the depth of the cavity 70 formed in the check rail. The keeper has a downward projection 84 for coaction with the rotatable locking cam 38 of the check rail lock when the handle 42 is in locked position. A decorative window strip 85 can overlie and extend upwardly from the keeper 11.

As seen particularly in FIG. 2, the keeper 11 is mounted in the check rail 72 sufficiently high as to permit mounting of weather stripping 86 and as a consequence is mounted generally at the level of the cavity 78 which receives the lower edge of the window glazing 74. In order to secure the keeper 11 in the cavity 70, the keeper is provided with a pair of downwardly inclined openings 90 and 92 extending from the face 80 which enable fasteners in the form of screws 93 and 94 to extend at a downward angle to thread into the check rail 72 and without interference with the glazing 74.

With the concealed cam lock and keeper positioned in association with the check rails 15 and 72 as seen in the drawings, all of the components except for the handle 42 are concealed. The components are mounted to enable the use of weather stripping coacting between the check rails and the keeper can be attached without interference with the glazing of the upper sash. As seen in FIG. 1, the handle can be provided with the directional arrow and the term "LOCK" in order to indicate the handle location when the rotatable locking cam 38 is positioned for coaction with the projection 84 of the keeper to lock the window.

I claim:

1. A check rail lock arranged for concealed mounting in a double hung window lower sash check rail defining a front face and a top face and having a cavity opening through the front face and top face thereof, said check rail lock comprising:

a housing defining a top wall, a front face, and a raised portion adjacent said front face and defining a top surface;

a shaft rotatably mounted in said housing and extending outwardly thereof;

a locking cam in said housing fixed to said shaft; and a handle fixed to said outer end of the shaft to be disposed at a greater distance from said top wall than from said top surface of the raised portion and only partially overlying said raised portion in one position thereof whereby the housing, shaft, and raised portion can be inserted through the check rail front face into the cavity thereof, with said raised portion top surface flush with the top face of the check rail, said check rail lock being arranged so that said handle is the only element of the check rail lock which is disposed above the top surface of the check rail when the check rail lock is mounted in the check rail cavity;

a keeper adapted to be mounted in a cavity in the upper sash check; and inclined openings in said keeper for directing fasteners extended therethrough downwardly as a result of mounting the keeper to the upper sash check rail.

2. A check rail lock arranged for concealed mounting in a double hung window lower sash check rail defining a front face and a top face and having a cavity opening through the front face and top face thereof, said check rail lock comprising:

a housing defining a top wall, a front face, and a raised portion adjacent said front face and defining a top surface;

a shaft rotatably mounted in said housing and extending outwardly from said top wall thereof;

a locking cam in said housing fixed to said shaft; and a handle fixed to said outer end of the shaft to be disposed at a greater distance from said top wall than from said top surface of the raised portion and only partially overlying said raised portion in one position thereof whereby the housing, shaft, and raised portion can be inserted through the check rail front face into the cavity thereof, with said raised portion top surface flush with the top face of the check rail, said check rail lock being arranged so that said handle is the only element of the check rail lock which is disposed above the top surface of the check rail when the check rail lock is mounted in the check rail cavity.

3. A check rail lock as defined in claim 2 and a keeper mountable in a cavity in a check rail juxtaposed to the front face of said check rail lock housing for coaction with said locking cam.

4. A check rail lock as defined in claim 3 wherein said keeper has a front face with at least a pair of openings for receiving fastening members, said openings being at an incline.

5. A check rail lock as defined in claim 2 wherein said handle has a generally conical base rising from above said raised portion of the housing, and said base being non-symmetrical relative to said shaft.

6. A window sash structure comprising:

a lower sash having a check rail defining a front face and a top face and having a cavity opening continuously through the front face and top face thereof; and a check rail lock comprising a housing having a top wall and a front portion provided with an upstanding closure wall, a shaft rotatably mounted in said housing and extending upwardly therefrom rearwardly of said closure wall, said shaft defining an upper end disposed above said top face of the check rail, a locking cam in said housing fixed to said shaft, and a handle fixed to said upper end of the shaft and partially overlying said closure wall in one position thereof whereby said housing, shaft and closure wall can be inserted through said sash front face into said cavity, said closure wall defining a top surface flush with said top face of said check rail and fully closing said cavity outwardly of said handle at said top face of the check rail.

7. A window sash structure comprising:

a lower sash having a check rail defining a front face and a top face and having a cavity opening continuously through the front face and top face thereof;

a check rail lock comprising a housing having a top wall and a front portion provided with an upstanding closure wall, a shaft rotatably mounted in said housing and extending upwardly therefrom rearwardly of said closure wall, said shaft defining an upper end disposed above said top face of the check rail, a locking cam in said housing fixed to said shaft, and a handle fixed to said upper end of the shaft and partially overlying said closure wall in one position thereof whereby said housing, shaft and closure wall can be inserted through said sash front face into said cavity, said closure wall defining a top surface flush with said top face of said check rail and fully closing said cavity outwardly of said handle at said top face of the check rail;

an upper sash having a check rail and defining a rear face confronting said front face of the lower sash check rail when the check rails are juxtaposed, said upper sash check rail having a cavity opening through said rear face;

a keeper in said cavity of the upper check rail; and downwardly inclined fasteners extending through said keeper into said upper check rail.

8. A check rail lock as defined in claim 7 wherein said keeper is flush with said rear face of the upper sash check rail.

* * * * *